US006322627B1

(12) United States Patent
Kusterman

(10) Patent No.: US 6,322,627 B1
(45) Date of Patent: Nov. 27, 2001

(54) APPLICATOR DEVICE

(75) Inventor: Martin Kusterman, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/326,870

(22) Filed: Jun. 7, 1999

(30) Foreign Application Priority Data

Jun. 17, 1998 (DE) ..... 198 27 030

(51) Int. Cl.[7] ..... B05C 1/08

(52) U.S. Cl. ..... 118/248; 118/249; 118/259; 118/126

(58) Field of Search ..... 118/248, 249, 118/257, 259, DIG. 14, DIG. 15, 413, 126; 427/355, 356, 359, 428

(56) References Cited

U.S. PATENT DOCUMENTS

| | | | | |
|---|---|---|---|---|
| 3,982,056 | * | 9/1976 | Holder, Jr. | 427/361 |
| 4,856,454 | | 8/1989 | Sieberth et al. | 118/126 |
| 5,340,611 | * | 8/1994 | Kustermann et al. | 427/361 |
| 5,401,314 | * | 3/1995 | Kustermann | 118/206 |
| 5,922,128 | | 7/1999 | Kustermann et al. | 118/110 |
| 6,123,770 | * | 9/2000 | Koskinen et al. | 118/110 |

FOREIGN PATENT DOCUMENTS

| | | |
|---|---|---|
| 37 15 307 C2 | 12/1988 | (DE) . |
| 38 40 610 A1 | 6/1990 | (DE) . |
| 42 18 596 C2 | 12/1993 | (DE) . |
| 43 38 776 A1 | 5/1994 | (DE) . |
| 94 21 631 U1 | 4/1996 | (DE) . |
| 0 651 095 A1 | 5/1995 | (EP) . |

* cited by examiner

*Primary Examiner*—Laura Edwards
(74) *Attorney, Agent, or Firm*—Taylor & Aust, P.C.

(57) ABSTRACT

A device for the application of a liquid or viscous coating medium onto a moving fiber material web, specifically a paper or cardboard web, includes an applicator unit, a first backing element which is assigned to the applicator unit and around at least a portion of the circumference of which the fiber material web travels, a leveling and/or metering device, and a second backing element which is assigned to the leveling and/or metering device and around at least a portion of the circumference of which the fiber material web travels. The surface characteristics of the first backing element and the second backing element are matched to each other so that the fiber material web—under the influence of the drive by the second backing element—may move relative to the first backing element.

15 Claims, 1 Drawing Sheet

APPLICATOR DEVICE

BACKGROUND OF THE INVENTION

1. Field of the Invention

The present invention relates to a device for the application of a liquid or viscous coating medium onto a moving fiber material web, such as a paper or cardboard web.

2. Description of the Related Art

Devices for applying a coating medium onto a fiber web typically include an applicator unit and a first backing element. The first backing element is assigned to an applicator unit around the circumference of which the fiber material web travels at least partially. A leveling and/or metering device is assigned to a second backing element around the circumference of which the fiber material web travels at least partially.

Devices of this type where the fiber material web is guided around two separate backing elements, specifically backing rolls—one at the location of the coating medium application and the other at the location of leveling and/or metering of the applied layer, respectively—are described in German patent document nos. 43 38 776 A1, 94 21 631 U1, 37 15 307 C2 and EP patent document no. 0 651 095 A1.

For example, German patent document 43 38 776 A1 deals with the risk of creation of wrinkles in the fiber material web in the area between the applicator device and the leveling/metering device when both of these devices operate against one and the same backing roll. In order to rectify these problems it is suggested in German patent document 43 38 776 A1 to assign separate backing rolls to the applicator unit and to the leveling/metering device respectively, and to control the speed of the two backing rolls in such a way that a desired web tension is assured. This solution has the disadvantage that it requires the two backing rolls to be driven at synchronized speeds, and also requires a complex and costly control system for the entire coating line or the fiber material web production line, due to the consideration of the speed dependency of the two backing rolls.

SUMMARY OF THE INVENTION

The present invention provides a device for the application of a liquid or viscous coating medium onto a moving fiber material web which prevents the formation of wrinkles in the fiber material web. The surface characteristics of the first backing element and the second backing element are matched to one another such that the fiber material web may move at least relative to the first backing element. Through targeted control of the surface characteristics of the two backing elements, only the surface of the backing roll assigned to the leveling and/or metering device represents a fixed point relative to the fiber material web. The backing element assigned to the leveling and/or metering device and the fiber material web is in substantially slippage free contact with the fiber material web, while the backing roll assigned to the applicator unit and the fiber material web undertakes relative movement in the direction of fiber material web flow when necessary to prevent the formation of wrinkles in the fiber material web. This dislocation of the two backing rolls relative to each other, even without matching the speeds of the two backing rolls to each other, maintains a fiber material web tension which eliminates wrinkle formation. Although reference has been made in the prior text and will be made in the following text to backing rolls, it is to be understood that one or even both of the backing elements may be a continuous belt or, preferably, a continuous belt which runs around a backing shoe in the area of the applicator unit or the leveling and/or metering device.

There are various ways to achieve substantially slip free contact of the fiber material web with the surface of the second backing roll while there is at least a certain amount of relative movement of the first backing roll. In accordance with the first embodiment of the present invention, this is, for example, achieved by at least the surface of the first backing element being soft. A soft surface is understood to be a surface which meets the following conditions:

$$4\text{ mm} < t \cdot h_S \cdot c < 13\text{ mm}$$

whereby the thickness "t" of the surface layer, for example, the roll cover, is stated in millimeters, "$h_S$" is the hardness of the surface material according to Pusey & Jones hardness testing, and "c" is a constant with the value (1 mm)/(25.4 P&J). The effect of this first variable is based on the surface of the first backing roll being elastic so that negligible fluctuations of the web tension are compensated for, at least in part, by the "spring effect" of the soft surface of the first backing roll. The hardness of the surface of the first backing element has a value of at least 50 P&J (hardness testing according to Pusey & Jones). The surface of the first backing element is therefore substantially softer than, for example, the surface of applicator rolls in long dwell time applicators, or LDTA applicators. The surface hardness of the second backing element has a value of between approximately 50 Pusey & Jones and approximately 100 Pusey & Jones, preferably of between approximately 60 Pusey & Jones and approximately 80 Pusey & Jones. Thus, the first backing element may has a softer surface than the second backing element.

A second embodiment of the present invention provides that the surface of the first backing element has lower friction characteristics than the surface of the second backing element. In this embodiment, the surface of the first backing element has a friction coefficient $\mu$ of 0.45 max, preferably of 0.15 max. Such low friction coefficients are provided, for example, when the surface of the first backing element is constructed of chrome, "Chrome-Slick", ceramic, and other similar low-friction materials. In this instance, the fiber material web reacts to variations in the web tension through a slipping movement relative to the surface of the first backing roll.

A third embodiment of the present invention consists in that the surface of the first backing element is definably rougher than the surface of the second backing element. The surface of the first backing element has a median roughness depth that is an arithmetic median roughness value (according to DIN 4768) of between 1.5 $\mu$m and 63 $\mu$m, preferably of between 6.3 $\mu$m and 30 $\mu$m. The roughness of the first backing roll results in an air boundary layer forming on the surface thereof during rotation. In the area of the backing roll that is encircled by the fiber material web, this air boundary layer forms an air cushion on which the fiber material web "floats". The air layer allows a relative movement between the backing roll and the fiber material web. The rough configuration of the roll surface enables the surface to exhibit a low dynamic friction coefficient which is dependent upon the prevailing operating conditions.

The three previously discussed embodiments can be realized simultaneously on one and the same backing roll, and in any preferred combination. For example, the roughness according to the third embodiment may be provided in a surface cover of the backing roll, which would consist of a soft material, i.e., through embedded fibers in the soft material ("suede effect"). In this combination, the "floating effect" of the roll surface roughness will dominate at high operating speeds, while the "spring effect" of the soft roll surface material will ensure a relative movability between the fiber material web and first backing roll at lower operating speeds.

Yet another embodiment of the present invention is realized with both backing elements being backing rolls, and whereby the distance "a" between the shafts of both backing rolls conform to the following conditions:

$$555\ \text{mm} < a < 0.5 \cdot ((v_{max} + v_{min})/v_{max}) \cdot (W/D) \cdot 1500\ \text{mm}$$

whereby $v_{max}$ is the maximum provided running speed of the web, $v_{min}$ is the minimum provided running speed of the web, W is the fiber material web width and D is the diameter of the second backing roll.

The unsupported length of the fiber material web between the two backing rolls is selected to be such that fluctuations in tension are compensated for by the inherent elasticity of the fiber material web. However, the unsupported length of the fiber material web should not exceed a certain limit, which depends on the minimum or maximum running speed of the fiber material web, the fiber material web width and the metering backing roll diameter. It is recognized that, at the same running speeds, a positive and wrinkle-free web travel can be achieved with fiber material webs of varying widths by selecting appropriately different shaft distances. The backing roll diameter is entered as a correction factor, since wider machines typically have larger backing rolls.

BRIEF DESCRIPTION OF THE DRAWINGS

The above-mentioned and other features and advantages of this invention, and the manner of attaining them, will become more apparent and the invention will be better understood by reference to the following description of embodiments of the present invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
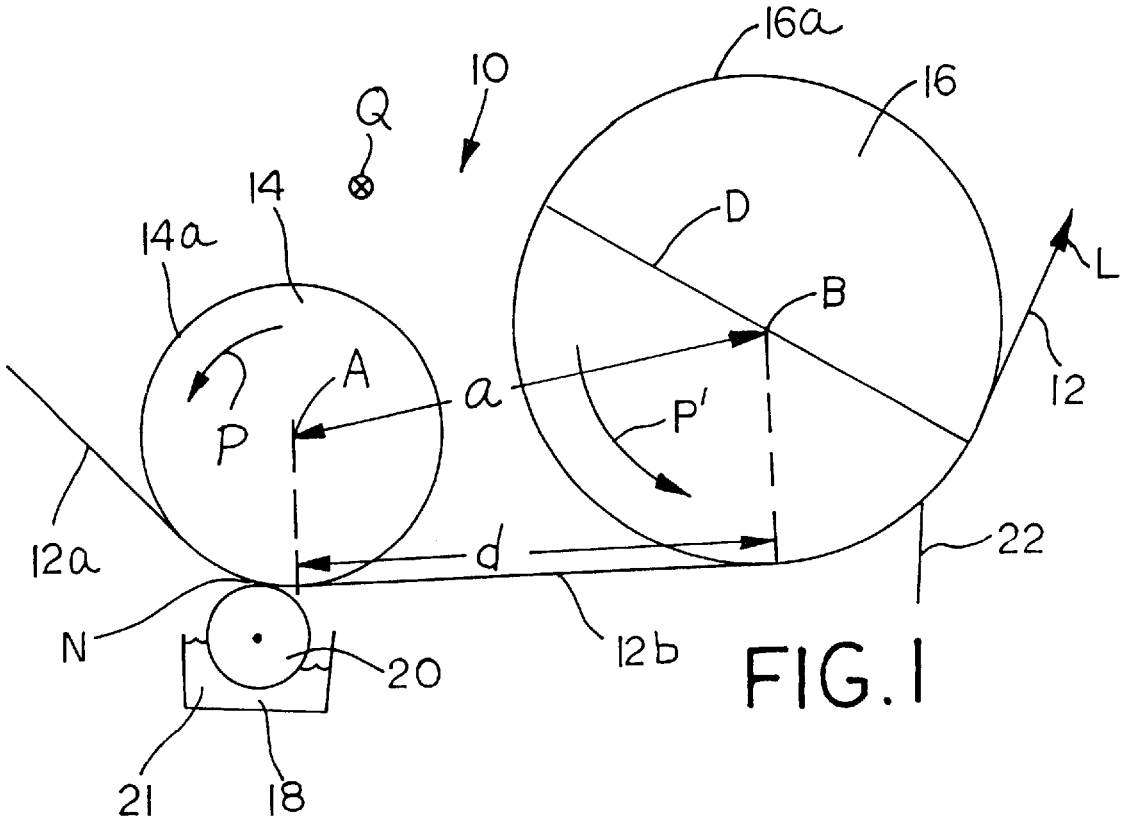
FIG. 1 is a schematic side view of an embodiment of an applicator device of the present invention.

Referring now to the drawings and particularly to FIG. 1, there is shown an applicator device 10 of the present invention. Viewed in flow direction L, a fiber material web 12 travels first around a first backing roll 14 and then around a second backing roll 16. The backing rolls 14 and 16 rotate around their respective axes A and B in the direction of the arrows P and P'. Only the second backing roll 16 is equipped with a rotary drive, while the first backing roll 14 rotates under the influence of the slaving effect of the fiber material web 12.

An applicator unit 18 for the application of liquid or viscous coating medium 21 onto the surface 12*a* of the fiber material web 12 is assigned to the first backing roll 14. The applicator unit 18 is illustrated in FIG. 1 as an applicator unit utilizing a scoop roll 20. It must be emphasized that any type of suitable applicator unit may be utilized with the applicator device of the present invention. Similarly, the leveling and/or metering device 22 which is assigned to the second backing roll 16 is illustrated as a doctor blade. The leveling and/or metering device can, for example, also be configured as a smooth or grooved metering rod, an air knife, etc.

According to a first embodiment, the surface 14*a* of the first backing roll 14 is softer than 40 Pusey & Jones and/or, according to a second embodiment, has less friction than surface 16*a* of the second backing roll 16 and/or, according to a third embodiment, displays a predetermined surface roughness. It is understood that the surface characteristics may be provided by either the material from which the backing rolls 14 and/or 16 are constructed, or by the roll surface cover of these rolls.

The function of the first embodiment is based on a "spring effect" of the soft surface material of first backing roll 14, which provides compensation for the fluctuations of the tension exerted upon the fiber material web 12. In the second embodiment, these fluctuations are compensated for by slippage of the fiber material web 12 on the backing roll surface. Finally, the function of the third embodiment is based on a "floating up" of the fiber material web 12 onto an air layer which forms on the roll surface, whereby the tension fluctuations again are compensated for by slippage of the fiber material web 12 relative to the backing roll.

In addition, the rotational shafts A and B of the two backing rolls 14, 16 exhibit a distance "a", which satisfies the following conditions:

$$555\ \text{mm} < a < 0.5 \cdot ((v_{max} + v_{min})/v_{max}) \cdot (W/D) \cdot 1500\ \text{mm}$$

whereby $v_{max}$ is the maximum provided running speed of the fiber material web, $v_{min}$ is the minimum provided running speed of the fiber material web, W is the width of fiber material web 12 in cross direction Q, and D is the diameter of the second backing roll 16. This ensures that the unsupported, non-guided fiber material web section 12*b* between the two backing rolls 14 and 16 in flow direction L exhibits a length "d" which is sufficient to compensate for fluctuations in the tension by the inherent elasticity of the fiber material web 12.

It is recognized that with the same fiber material web running speed, a positive and wrinkle-free fiber material web travel is achieved with fiber material webs of different width by selecting appropriately different shaft distances. The backing roll diameter is entered as a correction factor since wider machines typically have larger backing rolls.

Figure 2:
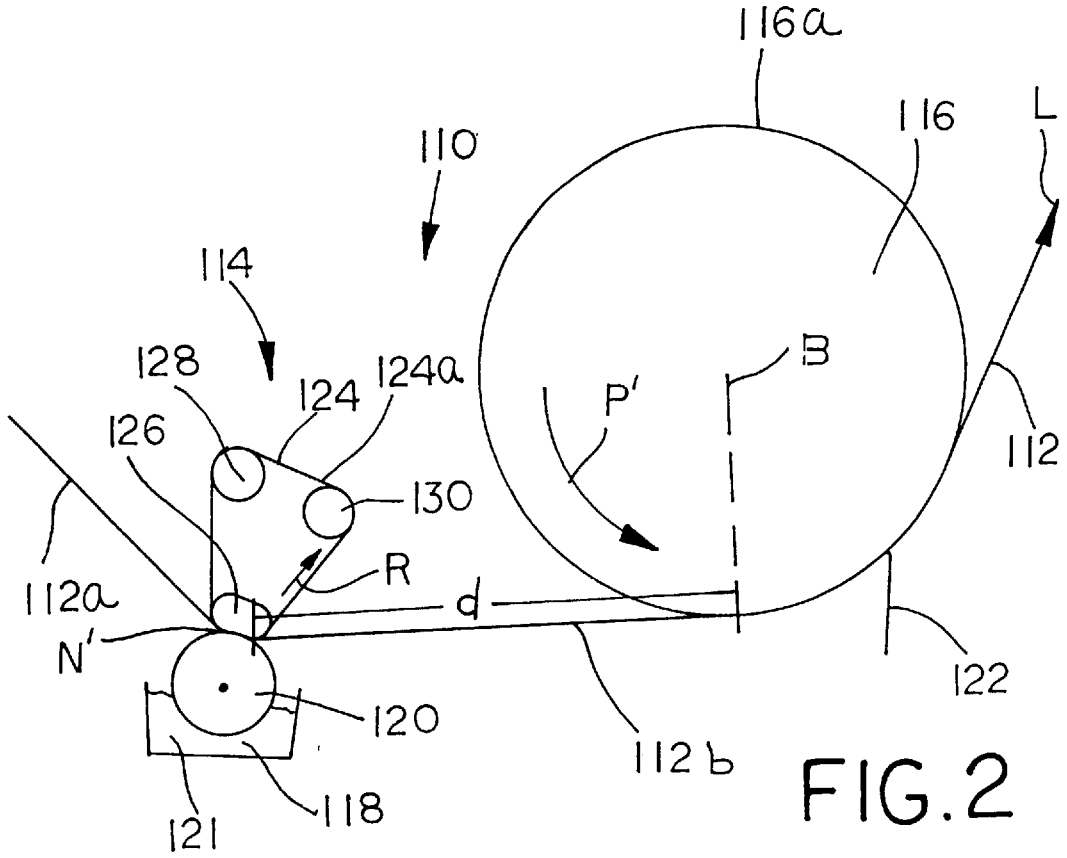
FIG. 2 is a schematic side view of a second embodiment of an applicator device of the present invention.

FIG. 2 depicts a second embodiment which closely corresponds to that in FIG. 1. Therefore, similar components in FIG. 2 are identified with similar reference numerals as in FIG. 1, increased by an increment of 100. The features in FIG. 2 are described only in as far as they differ from the example in FIG. 1.

The applicator unit 110 (FIG. 2) distinguishes itself from the applicator unit 10 (FIG. 1) only in that, in place of the backing roll 14, a backing device 114 is provided. Backing device 114 includes a continuous belt traveling around a contact shoe 126, and around two turning rolls 128 and 130 in direction of arrow R. The coating of the surface 112*a* of the fiber material web 112 with coating medium 121 is accomplished by use of an applicator unit 118, equipped with scoop roll 120. The surface of the contact shoe 126 which faces toward the scoop roll 120 is concave. Thus, a longer nip N' is provided between the scoop roll 120 and the contact shoe 126 (FIG. 2), than the nip N formed between the scoop roll 20 and the backing roll 14 (FIG. 1). The statements made in the context of the description for the design example according to FIG. 1 with regard to the backing roll 14 apply similarly to the example in FIG. 2 to the properties of the continuous belt 124 and/or the surface 124*a* thereof. It must be emphasized that these characteristics are provided either by the entire material of the continuous belt 124, or by a surface coating of this continuous belt 124. Regarding the backing roll 116, surface 116*a* and the leveling and/or metering device 122, the statements made with regard to the design example in FIG. 1 apply.

Likewise, in the design example according to FIG. 2, the length "d" of the non-supported section 112*b* of fiber material web 112 between the backing element 114 and the backing roll 116 is dimensioned such that fluctuations in the tension are compensated for by the inherent elasticity of the fiber material web 112 alone.

In addition, as used herein, the term "Chrome-Slick" refers to a surface which is created by etching a chrome surface and depositing teflon into the cavities which were created by the etching process. Such surfaces provide advantageous non-stick and wear and tear characteristics.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator device for the application of a coating medium onto a moving fiber material web, the moving fiber material web having a direction of travel, said applicator device comprising:

an applicator unit configured for applying the coating medium onto a first side of the moving fiber material web;

a first backing element assigned to said applicator unit, said first backing element having a first outside surface configured to engage a second side of the moving fiber material web, said first outside surface having a first surface characteristic, said first surface characteristic including a first coefficient of friction;

a metering element disposed subsequent to said applicator unit relative to the direction of travel of the moving fiber material web, said metering device configured for leveling the coating medium applied to the first side of the moving fiber material web; and a second backing element assigned to said metering device, said second backing element having a second outside surface configured to engage in a substantially slippage free manner the second side of the moving fiber material web, said second backing element having a second surface characteristic, said second characteristic including a second coefficient of friction;

wherein said first surface characteristic and said second surface characteristic conjunctively define a means for allowing movement of the moving fiber material web relative to said first backing element, said allowing means including said first coefficient of friction being less than said second coefficient of friction.

2. The applicator device of claim 1, wherein at least one of said first backing element and said second backing element comprises a backing roll.

3. The applicator device of claim 1, wherein said first backing element comprises a continuous belt.

4. The applicator device of claim 3, further comprising at least one support shoe, said support shoe supporting said continuous belt, said continuous belt traveling around said support shoe.

5. The applicator device of claim 1, wherein said allowing means comprises said first outside surface of said first backing element having a surface thickness t and a hardness $h_8$ expressed in P&J, such that:

$$4\text{ mm}<(t\cdot h_8\cdot c)^{0.5}<13\text{ mm};$$

wherein c is a constant having the value of 1 mm/25.4 P&J.

6. The applicator device of claim 5, wherein said hardness of said first outside surface of said first backing element is at least 40 P&J.

7. The applicator device of claim 5, wherein said second outside surface of said second backing roll has a hardness, said hardness being greater than 50 P&J and less than 100 P&J.

8. The applicator device of claim 5, wherein said hardness of said outside surface of said second backing roll is greater than 60 P&J and less than 80 P&J.

9. The applicator device of claim 1, wherein said first coefficient of friction is one of less than and equal to 0.45.

10. The applicator device of claim 1, wherein said first coefficient of friction is one of less than and equal to 0.15.

11. The applicator device of claim 1, wherein said means for allowing movement of the moving fiber material web relative to said first backing element comprises the first outside surface of said first backing element having a first surface roughness, said second outside surface of said second backing element having a second surface roughness, said first surface roughness being greater than said second surface roughness.

12. The applicator device of claim 11, wherein said first surface roughness has a median value of roughness approximately between 1.5 $\mu$m and 63 $\mu$m.

13. The applicator device of claim 11, wherein said first surface roughness has a median value of roughness approximately between 6.3 $\mu$m and 30 $\mu$m.

14. The applicator device of claim 1, wherein said first backing element comprises a first backing roll, said second backing element comprises a second backing roll, said second backing roll having a diameter D, said first backing roll supported by a first shaft, said second backing roll supported by a second shaft, said first shaft separated by distance a from said second shaft, the moving fiber material web having a maximum speed of travel $v_{max}$, a minimum speed of .travel $v_{min}$, and a width W, such that:

$$555\text{ mm}<a<0.5\cdot((v_{max}+v_{min})/v_{max})(W/D)\cdot 1500\text{ mm}.$$

15. An applicator device for the application of a coating medium onto a moving fiber material web, the moving fiber material web having a direction of travel, said applicator device comprising:

an applicator unit configured for applying the coating medium onto a first side of the moving fiber material web;

a first backing element assigned to said applicator unit, said first backing element having a first outside surface configured to engage a second side of the moving fiber material web, said first outside surface having first surface characteristics, said first surface characteristics including a first coefficient of friction and a first surface roughness;

a metering element disposed subsequent to said applicator unit relative to the direction of travel of the moving fiber material web, said metering device configured for leveling the coating medium applied to the first side of the moving fiber material web; and a rotatably driven second backing element assigned to said metering device, said second backing element having a second outside surface configured to engage the second side of the moving fiber material web, said second outside surface having second surface characteristics matched to said first surface characteristics such that the fiber web can be driven by said second backing element over said first outside surface of said first backing element, said second surface characteristics including a second coefficient of friction and a second surface roughness, wherein said second coefficient of friction is greater than said first coefficient of friction, and said second surface roughness is less than said first surface roughness.

* * * * *